US008061344B2

(12) United States Patent
Dofher

(10) Patent No.: US 8,061,344 B2
(45) Date of Patent: Nov. 22, 2011

(54) SLAB SAW WITH DUST COLLECTOR AND METHOD OF DRY-CUTTING PAVEMENT

(75) Inventor: Darren Dofher, Port Coquitlam (CA)

(73) Assignee: Teraspan Networks Inc. (CA)

( * ) Notice: Subject to any disclaimer, the term of this patent is extended or adjusted under 35 U.S.C. 154(b) by 801 days.

(21) Appl. No.: 11/853,489

(22) Filed: Sep. 11, 2007

(65) Prior Publication Data

US 2008/0060631 A1 Mar. 13, 2008

Related U.S. Application Data

(60) Provisional application No. 60/843,408, filed on Sep. 11, 2006.

(51) Int. Cl.
*B28D 1/04* (2006.01)

(52) U.S. Cl. ..... 125/13.01; 125/38; 144/252.1; 451/456

(58) Field of Classification Search ..... 15/300.1, 15/347; 30/390, 391, 124; 83/100; 125/12, 125/13.01, 38; 144/252.1; 451/344, 451, 451/456; 299/39.3
See application file for complete search history.

(56) References Cited

U.S. PATENT DOCUMENTS

| | | | | | |
|---|---|---|---|---|---|
| 1,888,679 | A * | 11/1932 | Knapp | 83/440.2 |
| 3,034,493 | A * | 5/1962 | Bandy | 125/13.01 |
| 3,585,980 | A * | 6/1971 | Mellor | 125/13.01 |
| 3,882,598 | A * | 5/1975 | Earle et al. | 30/390 |
| 4,063,478 | A | 12/1977 | Stuy | 83/100 |
| 4,192,104 | A * | 3/1980 | Patenaude | 451/456 |
| 4,241,505 | A | 12/1980 | Bodycomb, Jr. et al. | 30/390 |
| 4,253,362 | A | 3/1981 | Olson | 83/100 |
| 4,255,995 | A | 3/1981 | Connor | 83/100 |
| 5,074,044 | A * | 12/1991 | Duncan et al. | 30/124 |
| 5,167,215 | A | 12/1992 | Harding, Jr. | 125/13.01 |
| 5,440,809 | A * | 8/1995 | Padilla | 30/124 |
| 5,537,748 | A * | 7/1996 | Takahashi et al. | 30/124 |
| 5,579,753 | A * | 12/1996 | Chiuminatta et al. | 125/12 |
| 6,648,742 | B1 * | 11/2003 | Segiel, Jr. | 451/451 |
| 6,935,939 | B1 * | 8/2005 | Buser et al. | 451/451 |
| 7,465,328 | B2 * | 12/2008 | Trautner et al. | 55/385.1 |
| 2003/0096560 | A1 * | 5/2003 | Harrington | 451/28 |
| 2007/0096539 | A1 * | 5/2007 | Walker et al. | 299/39.3 |

* cited by examiner

*Primary Examiner* — Timothy V Eley
(74) *Attorney, Agent, or Firm* — Ostrolenk Faber LLP

(57) ABSTRACT

A dust collector is provided for use with a SLAB saw, especially suited for dry-cutting a channel within pavement or similar exterior surface. The collector includes telescoping upper and lower housings, an open front and lower base to receive a portion of a circular saw into the interior of the housing, and an exhaust outlet, for attaching to a vacuum duct, so as to exhaust dust-laden air from the interior of the housing. The housing includes a pivot mount, pivotally mounting the unit to a slab saw. Also provided is a system, including the dust collector with a circular saw and optionally a vacuum source and dust filter unit or units. Also provided is a method for dry-cutting a trench or channel within pavement or similar hard outside surface, which is particularly suitable for laying of cable such as fiber optic cable. The method may include the step of cutting through the pavement into the underlying hard-packed substrate.

13 Claims, 10 Drawing Sheets

SLAB SAW WITH DUST COLLECTOR AND METHOD OF DRY-CUTTING PAVEMENT

This application claims the benefit of U.S. application No. 60/843,408, filed on Sep. 11, 2006.

FIELD OF THE INVENTION

The invention relates to equipment for construction and road cuts, in particular to dust shrouds and dust collectors for portable slab saws, in particular for pavement cutting and the like.

BACKGROUND OF PRIOR ART

Slab saws are commonly used for generating cuts in pavement, stone and other hard surfaces typically found in outside environments. A typical slab saw includes a frame supported by wheels, a power unit for driving the saw, such as a gas or diesel motor, and a rotary blade. Pavement cuts formed by a slab saw may be used for a variety of purposes, including forming a narrow trench for installation of cables. In one application, a slab saw may be used to cut through an overlying pavement layer into the sub-grade material. Conventionally, this has been carried out via a wet-cutting process, involving directing a stream of water onto the saw blade for cooling and to wash away the dust generated by the cutting action. Wet-cutting of this type typically generates a relatively large volume of mud, which requires cleaning and disposal. As well, wet-cutting typically deposits a layer of mud on the walls of the cut. In certain applications, it is desirable to provide a clean cut, for example where the resulting cut is used for installation of cables and the like. For this application, the deposited mud layer must be cleaned from the inside of the cut, which requires considerable effort and water. It is therefore desirable to provide a dry cutting method, which leaves a relatively clean cut while also permitting easier removal and disposal of the dust resulting from the cutting operation. However, a challenge in providing a dry cutting method is to evacuate the dust generated by the blade in an easy and convenient manner.

Circular saws for carpentry use typically include a full or partial shroud for trapping of dust. The shroud may communicate with a vacuum source, for disposal of the dust. An example of a carpenter's saw of this type is shown in U.S. Pat. No. 5,327,649, to Sklower. A dust shroud for a portable circular saw is also described in U.S. Pat. No. 4,241,505, to Bodycomb, Jr., et al., which describes a portable circular saw having a two-part dust shroud consisting of upper and lower housings, joined together by an external attachment link. The housings are spaced apart, to permit a workpiece to be received between the housings during cutting Dust collection shrouds for circular saws are also disclosed in U.S. Pat. No. 4,255,995 to Connor, U.S. Pat. No. 4,063,478 to Stuy and U.S. Pat. No. 4,253,362 to Olson.

Circular saws for carpentry, while often including a shroud for collecting dust, differ from slab saws for pavement cutting. Slab saws present different challenges from carpentry saws for preventing dust dispersal. Hence, there is a need for a convenient system for containing and removing dust during operation of a slab saw.

SUMMARY OF THE INVENTION

It is an object of the invention to provide an improved housing for collecting dust from a slab saw of the type used in cutting pavement or the like. It is a further object to provide an improved system that includes the improved housing, together with a vacuum source and dust filter. It is a further object to provide a method for dry cutting of pavement with a slab saw while removing dust generated during the cutting operation.

In one aspect, the invention relates to a dust collection system for use with a slab saw. The system comprises a dust collector housing having upper and lower parts that telescope or otherwise selectively extend apart from each other or retract together so as to vary the effective height of the housing. The housing has an at least partly open front and bottom faces to permit a portion of the circular blade to enter the housing on the upswing so as to discharge dust-laden air into the housing interior. The housing communicates with a vacuum source so as to withdraw the dust-laden generated by the blade.

Optionally, the upper part of the housing includes a baffle to direct dust into the interior of the housing. Optionally, the housing communicates with a duct that extends at covers at least a portion of the rear wall of the housing and communicates with the housing interior through a slotted opening opposed to the blade. The duct may comprise telescoping portions integrated with the upper and lower housing parts, so as to permit the duct to cover portions of both the upper and lower housings.

The invention also comprises a method of dry-cutting pavement or similar hard material, using a slab saw that optionally cuts fully through the pavement into the sub-grade below to leave a dry trench. The method involves integrating a dust collection system of the type described herein with a slab saw and a vacuum source, generating a vacuum within the dust collection compartment while dry-cutting a trench, and filtering at least a portion of the particulates from the air stream captured by the system. A portion of the saw blade enters the compartment on the upswing portion of its rotation and draws at least a portion of the dust and particulates generated by the cutting operation into the compartment, for removal via the vacuum source.

DETAILED DESCRIPTION

Figure 1:
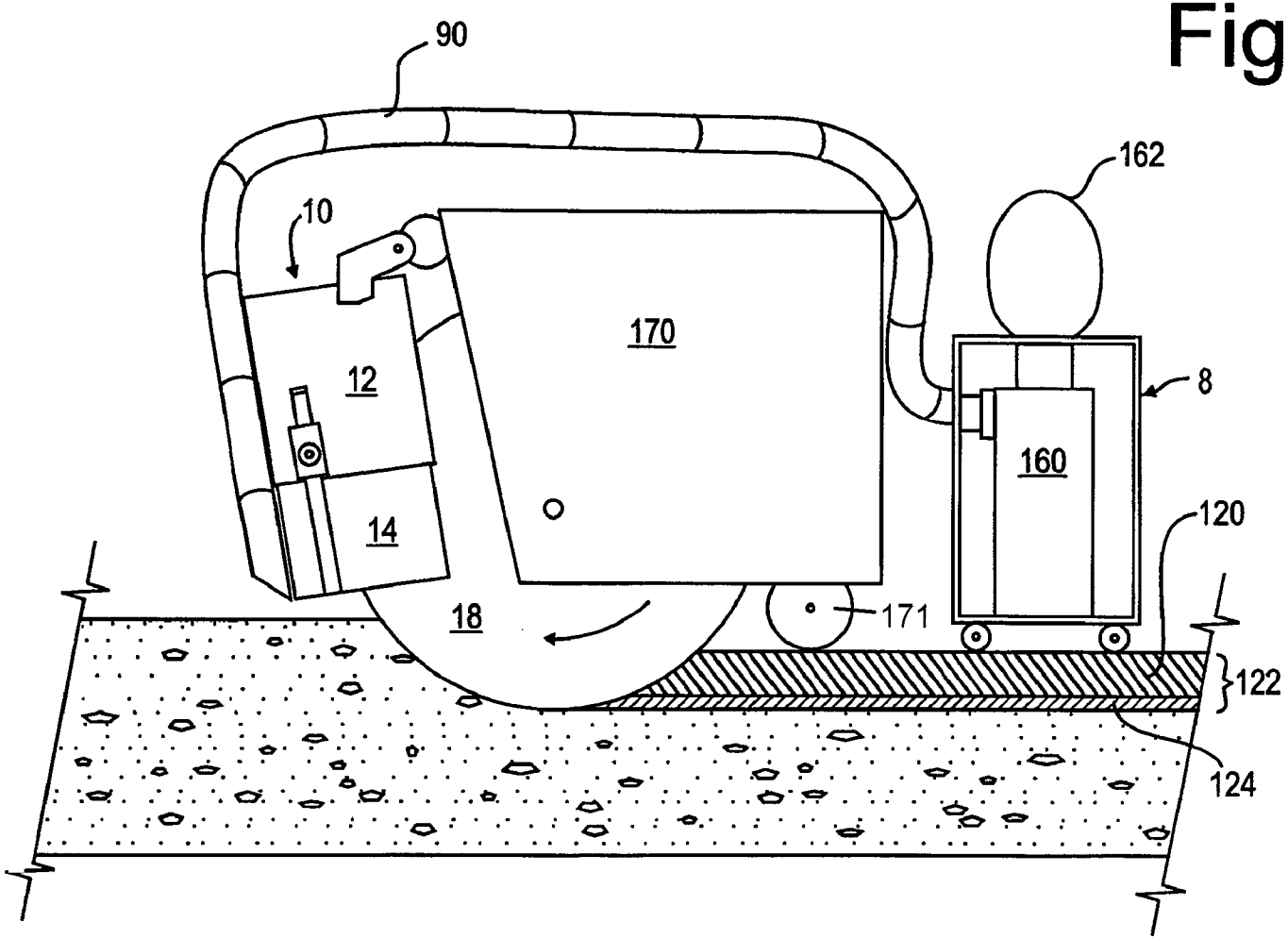
FIG. 1 shows a side elevation view, partly in section, of a system according to the present invention in operation, generating a cut through a section of pavement.

Referring to FIG. 1, the dust collector 10 described herein is intended to be connected to a conventional vacuum source and dust filter unit 8, which may comprise a fan unit 160, coupled with a filtration unit 162 such as a filter bag. As will be apparent, any suitable type of vacuum and dust filter unit may be provided, or in the alternative, the source may supply only a vacuum and the collector may simply exhaust the removed dust away from the user, for example if the device is to be used in an inside environment and a centralized remote filtration unit is provided. However, it is contemplated that a suitable use for the present invention is for dry-cutting of pavement, or other outdoor surface, using a slab saw to cut into the pavement or other similar surface. Typically, such applications raise significant amounts of dust that must be filtered to prevent the dust from entering into the local environment. In one non-limiting example, the dust collector unit supplies 1100 cfm vacuum.

The dust collector is intended to form a component of a system that also includes a slab saw 170 for dry cutting of pavement, and a vacuum/filter unit 8 for generating an airflow through the collector 10 and filtering the air prior to discharge. Slab saw 170 includes a frame supported by wheels 171.

A first embodiment is illustrated in FIGS. 2 through 9.

Figure 2:
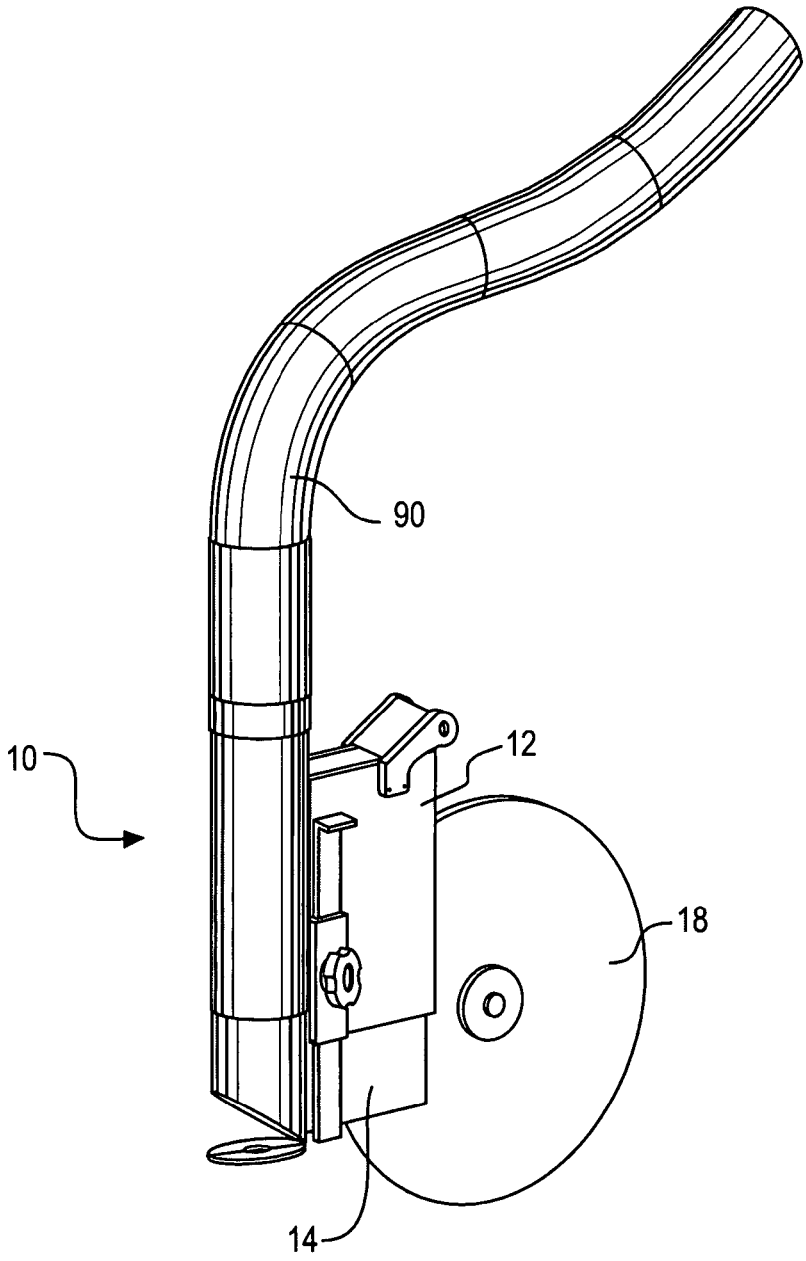
FIG. 2 is a perspective view of a dust collector according to the invention.
Figure 3:
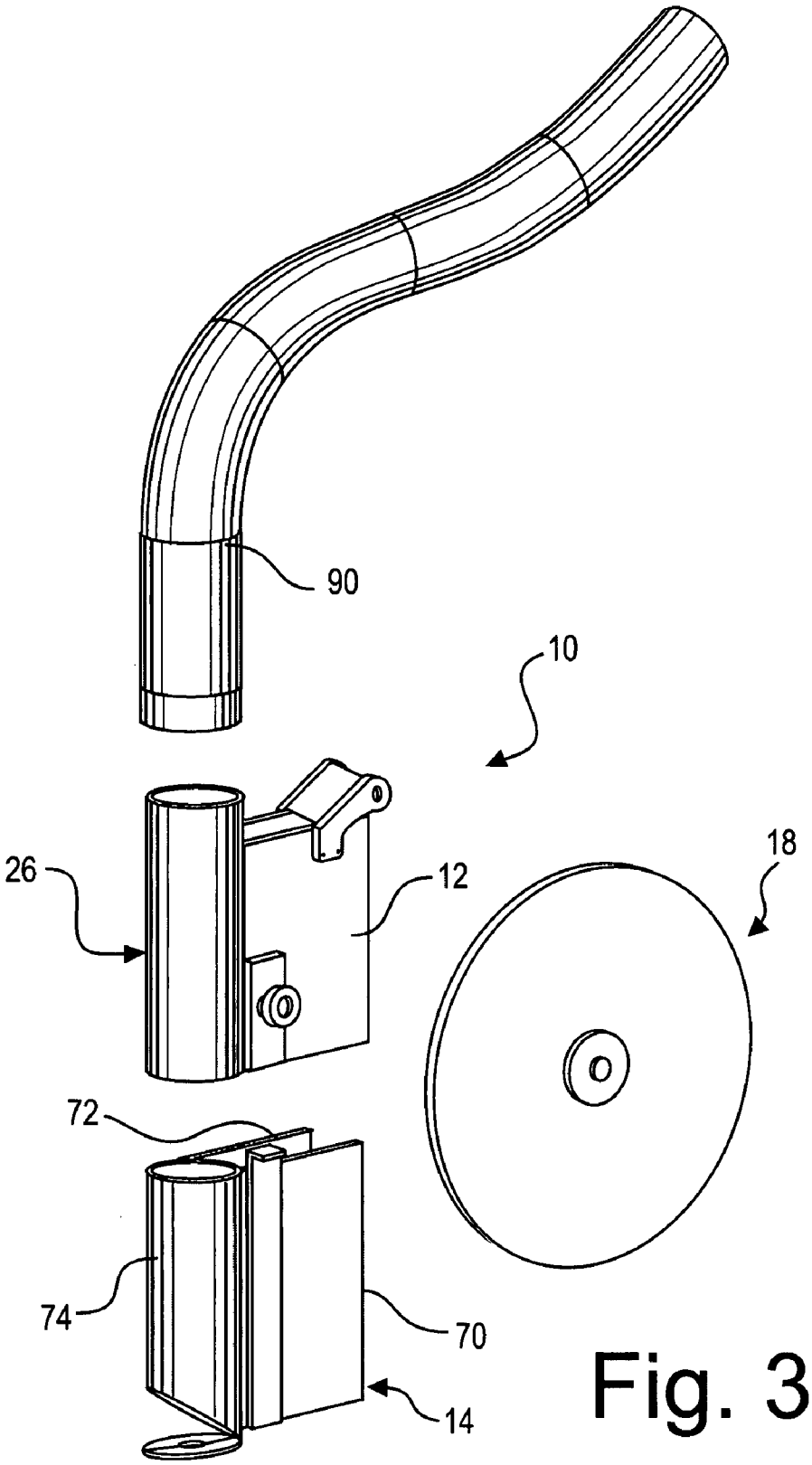
FIG. 3 is a perspective view according to FIG. 2, with the parts shown in exploded view.

Turning to FIGS. 2 and 3, the dust collector 10 comprises generally an upper housing 12 and a lower housing 14, a portion of which is disposed within the upper housing and telescopes downwardly therefrom so as to adjust the effective overall height of the collector to accommodate blades of different diameters. A vacuum duct 90 communicates with the collector 10, which in turn provides a source of suction from the vacuum source 8.

Figure 4:
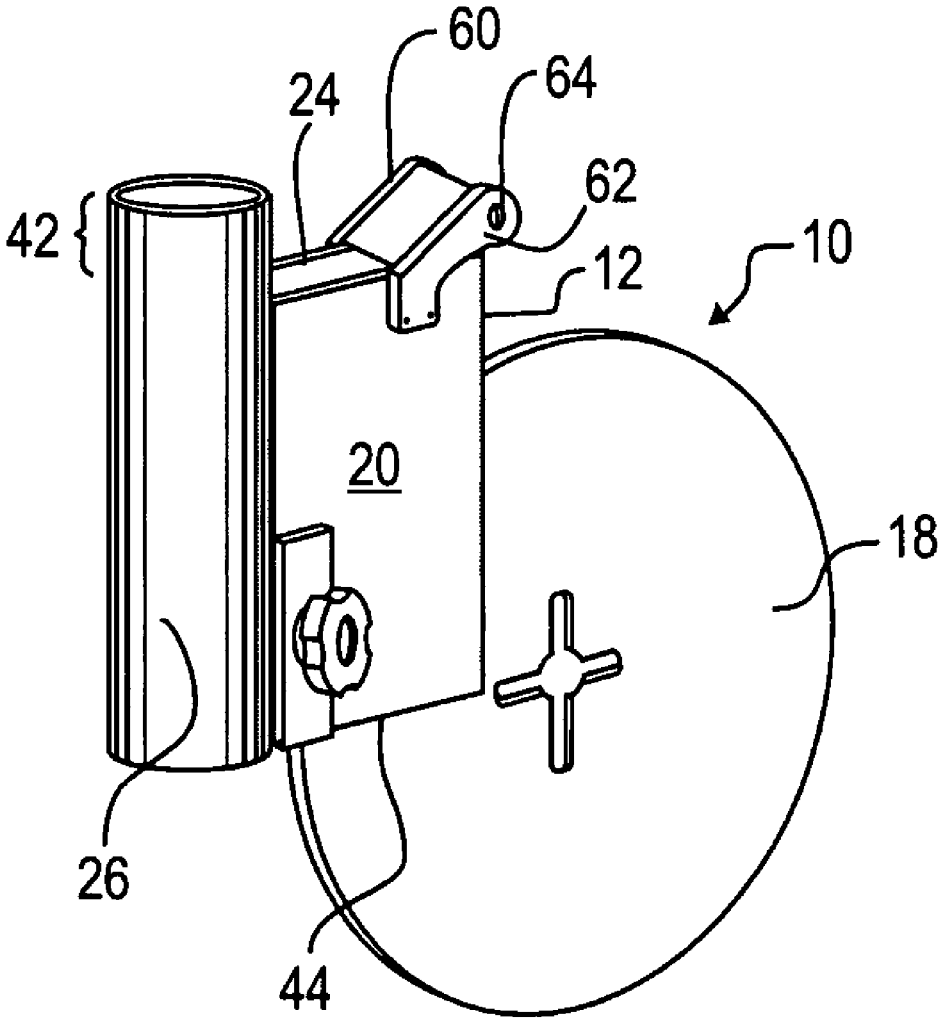
FIG. 4 is a perspective view of the upper dust collector portion of the device, together with a circular blade.
Figure 5:
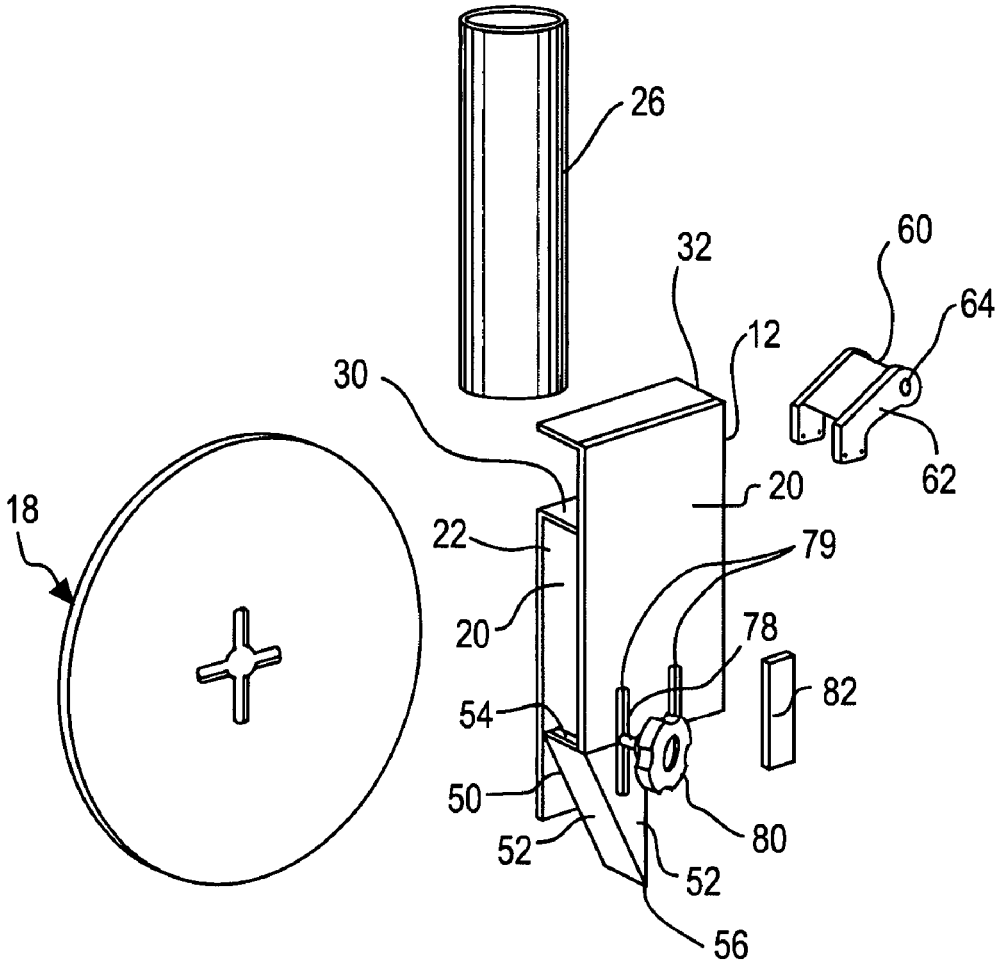
FIG. 5 is an exploded view of the portion shown in FIG. 4.

The upper housing 12, seen in more detail in FIGS. 4 and 5, comprises a generally rectangular structure having flat sides 20, an open front 22 for receiving a portion of a circular blade 18 within the interior of the housing 12, a closed top 24, a rear enclosure 26 comprising a tubular member and an open base 28. The blade 18 enters the housing through the open base and front. The sides 20 comprise two spaced apart rigid side panels which define an interior space therebetween. The panels 20 may be rectangular, as illustrated, although it will be readily seen that they may take on essentially any convenient shape. However, the rectangular shape shown in the figures is convenient since, amongst other advantages, this shape readily permits the telescoping feature described herein, and is thus particularly suited for the present invention. The opposed panels 20 are joined together by way of opposing flaps 30 and 32 extending from the upper edge of each panel. The respective flaps 30, 32 face each other, and when assembled the flaps overlap. The overlapping flaps form an upper substantially sealed lid of the housing 12, to partly enclose the interior space. The flaps 30 and 32 are held together by means of bolts or the like (not shown), extending through aligned apertures within the flaps.

The rear enclosure 26 of the upper housing 12 terminates at its upper end in a generally cylindrical tubular connector member 42 extending upwardly from the rear portion from the housing 12. The enclosure 26 thus effectively forms an extension of the duct 90 so as to permit a relatively smooth and laminar flow of air through the system. The enclosure 26 includes a vertically extending slotted opening 36 in its lower region 40 to communicate with the interior of the upper housing 12. The connector 42 extends upwardly above the sides 20, and is cylindrical for connecting with a suitably dimensioned vacuum duct. The lower end 44 of the enclosure 26 is open, to receive a corresponding lower enclosure 74 of the lower portion 14 in a sliding engagement. The enclosure 26 is fastened to the side panels 20, for example by welding, such that the slotted opening 36 in the tubular member has the same width as the spacing between the side panels 20 and is aligned therewith.

The upper housing 12 is provided with an internal baffle 50, housed within the interior space between the respective upper panels 20, and positioned at the upper end thereof. The baffle 50 is generally V-shaped when seen from the side. The baffle has a side-to-side width which is the same as the spacing between the side panels 20, to permit it to fit snugly within the interior of the housing 20. The baffle comprises a pair of diverging flat plates 52, the upper edges of which turn inwardly to form opposing flanges 54, which provide mounting surfaces such that the baffle may be conveniently bolted, screwed or otherwise fasted to the flaps 30 and 32 of the side plates 20. The lower edges of the baffle plates 52 converge towards a point 56 when seen from the side. The baffle is mounted within the dust collector such that one plate 52 faces the circular blade 18, leaving gap to provide clearance for the blade. In one aspect, the baffle 50 is removable, and a kit comprising several different sizes of baffles 50 is provided to accommodate circular blades of different diameters. The function of the baffle 50 is to reduce the amount of dust escaping the upper collector, by directing the dust-laden airflow towards the back of the collector where it may enter the duct for removal.

The collector 10 is mountable to a slab saw 170 via a pivot mount 60 mounted to upper housing 12 near the top front corner thereof. The mount 60 consists of opposing plates 62, having therein aligned apertures 64 therein for receiving a hinge pin, not shown. The mount 60 permits the collector 10 to be pivotally mounted to a slab saw 170 such that the dust collector structure may be pivoted upwardly and outwardly away from the saw when not in use; and then when in use, rotated back into the generally vertical position seen in FIG. 1. For example, the mount 60 may mount to the housing or support structure of a slab saw. When rotated into its use position, the blade 18 is partly enclosed between the opposed side panels 20 of the dust collector 10 such that when a sufficient vacuum is generated within the collector by the vacuum unit 160, dust-laden air generated by the saw is largely drawn into and filtered within the dust collector unit 160.

The lower housing 14 is slidably engaged to the upper housing 12 and telescopes downwardly therefrom when in the normal upright use position. The lower housing 14 is similar in shape to the upper housing 12, but has somewhat smaller outside dimensions so as to fit within the interior of the upper housing so these components may fit snugly together with a sliding engagement. The lower housing has an open front 70, an open top 72 to communicate with the upper housing, a closed partly cylindrical rear portion which comprises a tube 74, and partly open bottom 76 to accommodate a circular saw blade. The lower housing 14 comprises opposed spaced apart panels 73 similar in configuration to those of the upper housing 12, but spaced more closely together so as to slide within the interior space of the upper housing. The interiors of the upper and lower housing 12 and 14 communicate to form an uninterrupted hollow interior region that receives the circular saw blade.

A rigid vertically oriented elongate bar 77 is mounted to the outside surface of one of the panels 70 of the lower housing 14, and is slidably received within a corresponding sleeve 79 on a corresponding side panel of the upper housing. The upper end of the bar 77 terminates in an outwardly-facing flange 76, which serves as a stop to prevent the bar from sliding out from the sleeve 79. The bar 77 is fastened within the sleeve by means of a threaded tightening shaft 78 having a handle 80 for operation by the user, which fits within a threaded aperture 82 within the sleeve 79. The free end of the shaft 78 may simply press against the bar 77 to retain position by friction, or alternatively the bar 77 may include multiple recesses or apertures (not shown) to provide a more secure retention and fixed positions.

The bar 77 and sleeve 79 cooperate to form an adjustable retention means to retain the lower and upper housings 12 and 14 together in a selected fixed position. Loosening of the shaft 78 permits adjustment of these respective positions so as to adjust the overall height of the collector 10 to accommodate saw blades of different diameter.

Figure 7:
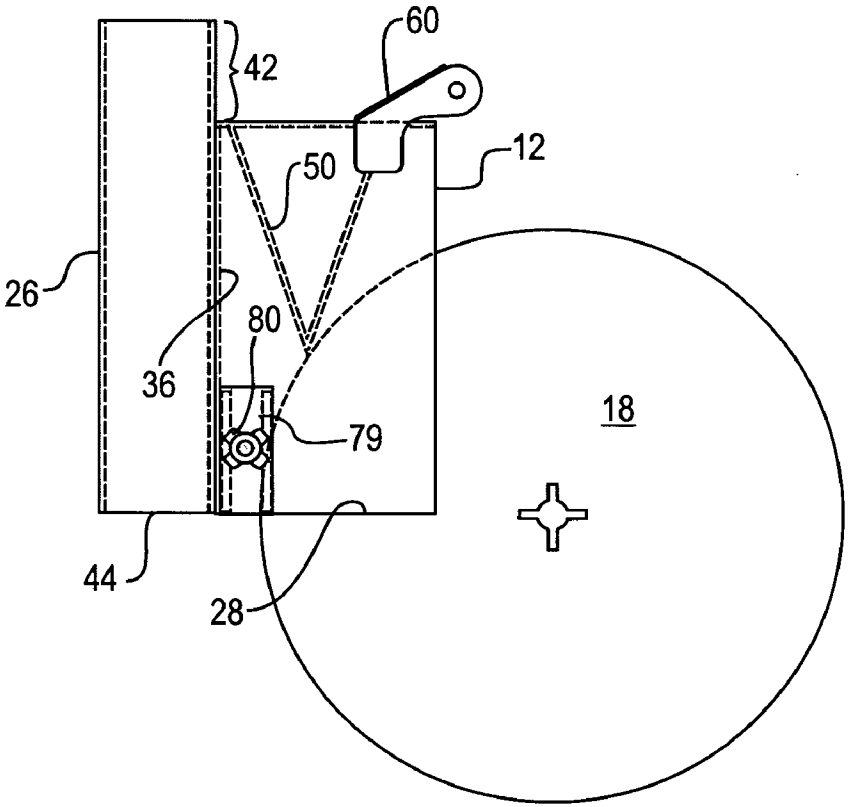
FIG. 7 is a side elevational view of the upper portion of the dust collector, with a side panel removed to show internal features, and showing a circular saw blade for reference.
Figure 6:
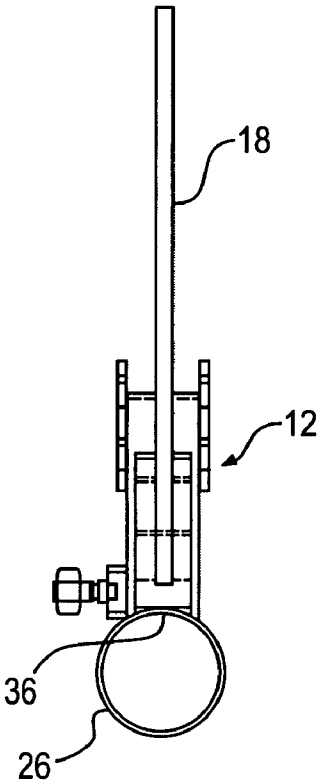
FIG. 6 is a bottom plan view of the upper portion of the dust collector.
Figure 8:
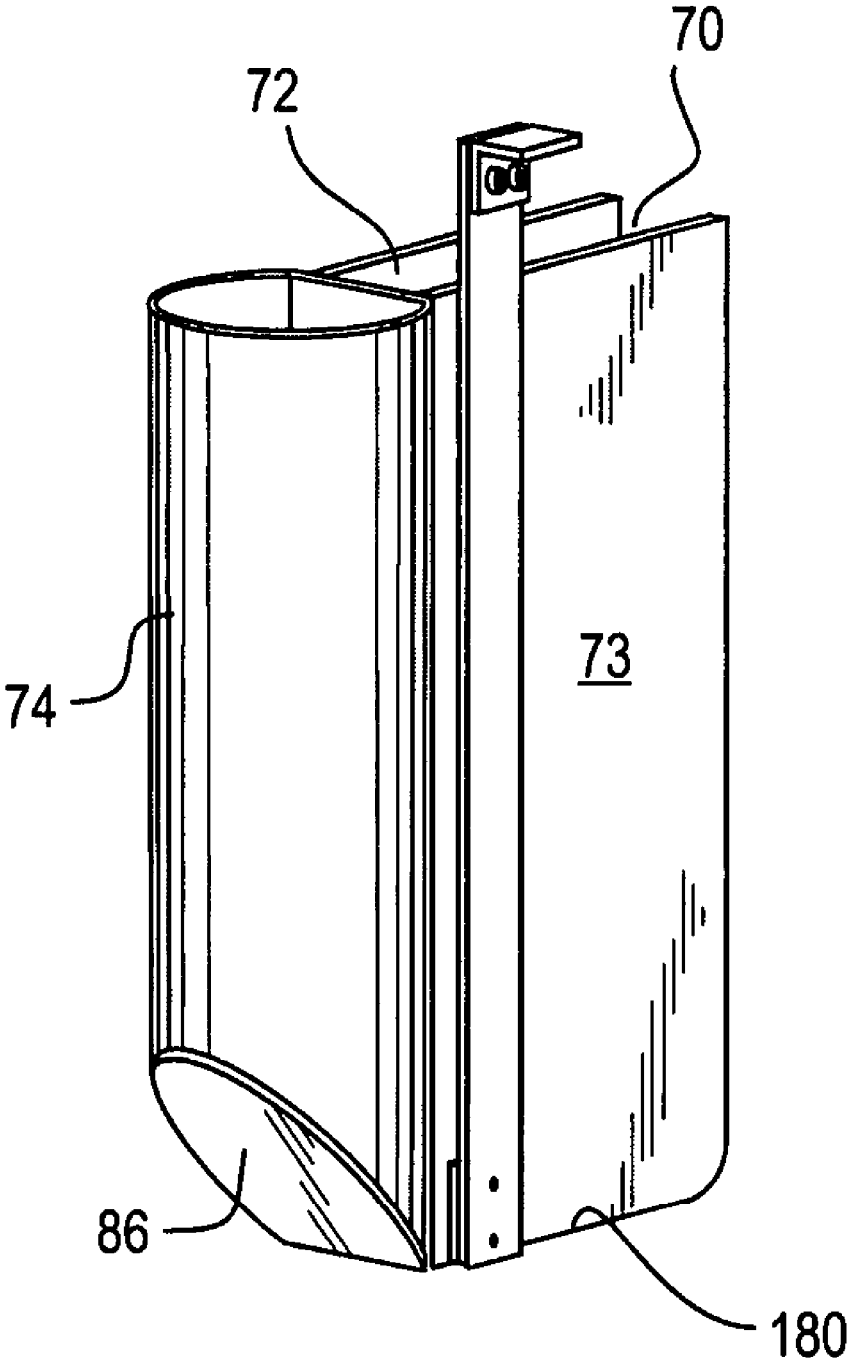
FIG. 8 is a perspective view of the lower portion of the dust collector.
Figure 9:
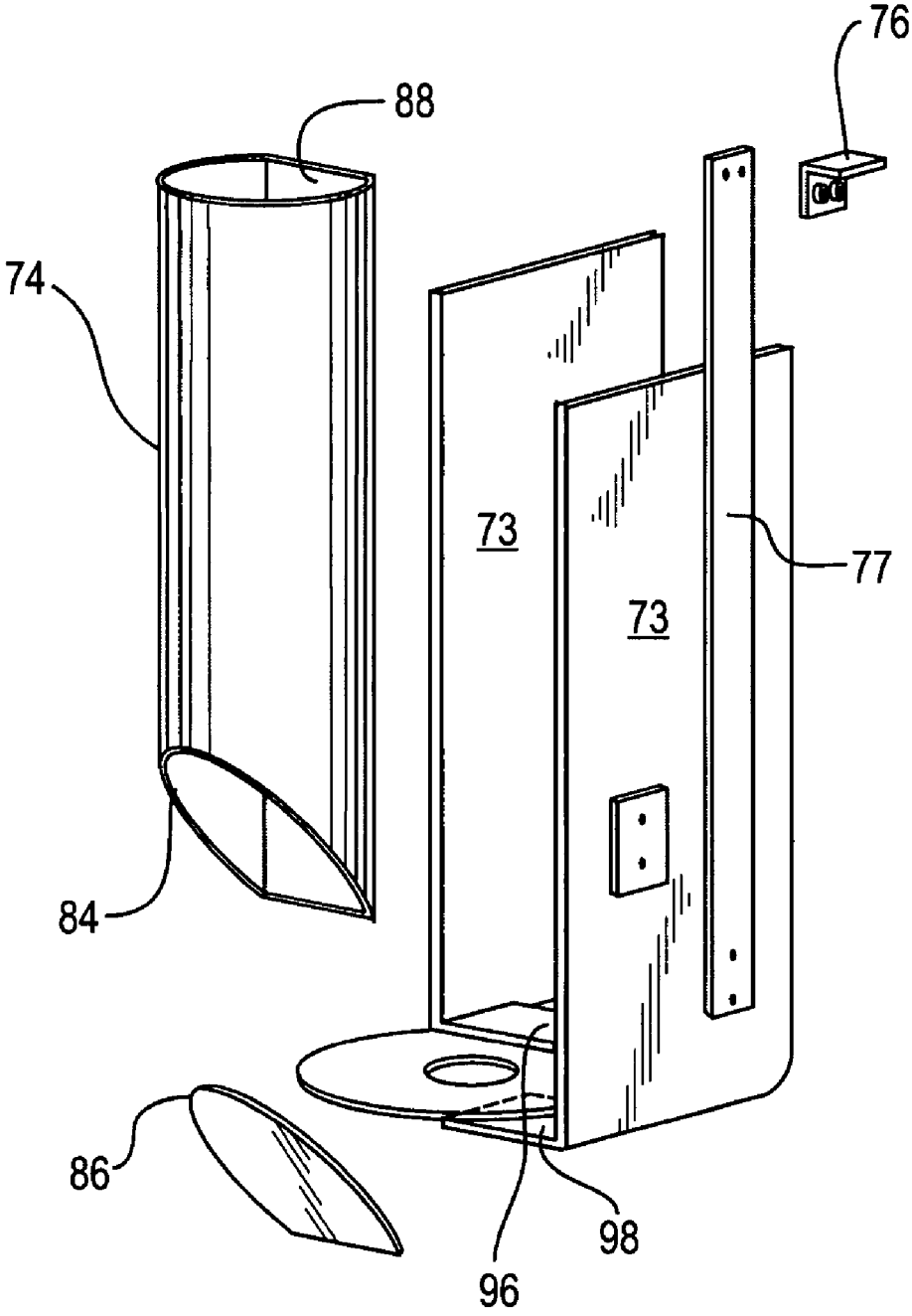
FIG. 9 is an exploded view of the portion shown in FIG. 8.
Figure 9B:
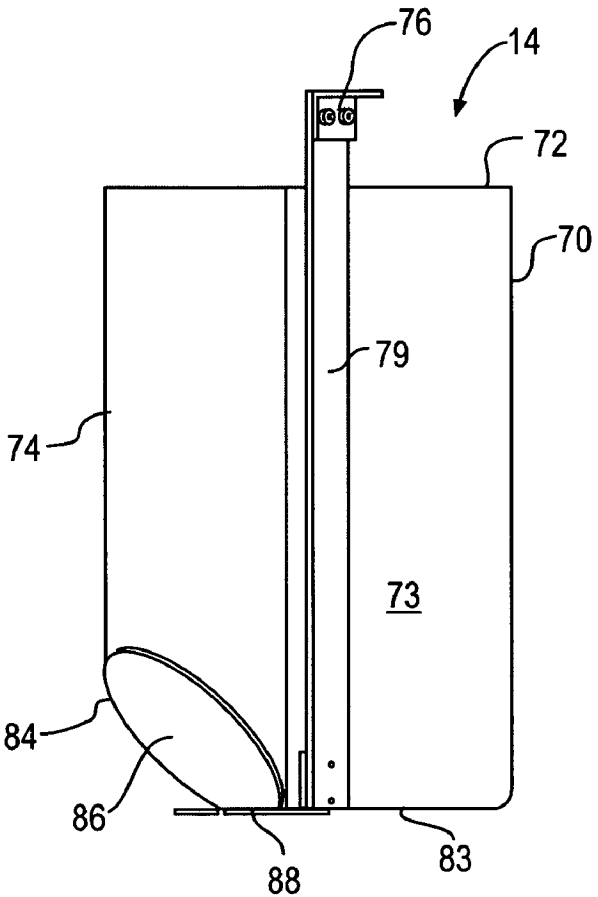
FIGS. 9A and 9B are bottom and side elevational views respectively of the lower compartment portion.
Figure 9A:
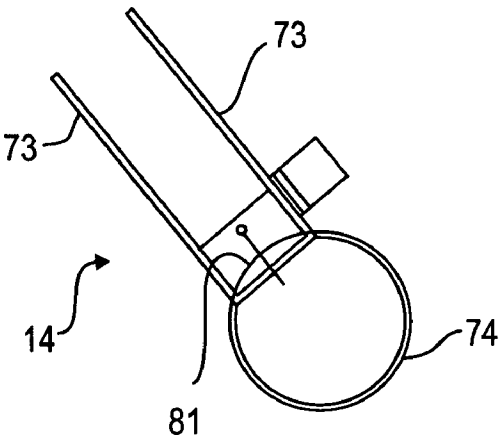

The rear of the lower collector consists of a lower cylindrical member 74, seen in FIGS. 6 through 9B, the open interior of which communicates with the interior of the lower housing 14 in the same manner as the upper housing. The lower cylindrical member 74 includes a vertically extending slotted opening 81 extending from top to bottom thereof to communicate with the interior of the housing 14. Preferably, the lower end 84 of the lower cylinder 74 is angled, as seen in FIGS. 6 and 7, so as to prevent denting or damage when the collector 10 is tilted rearwardly. The lower end 84 of the tubular member is capped with an lower tube cap 86, which may be permanently fastened, or alternatively, removeably engaged to selectively seal the end of the lower tube, for example by means of a hinge 88.

The opposing side panels 73 of the lower housing 14 terminate at their lower end, each with an inwardly facing flap 98 and 96, in a similar fashion to the flaps 30 and 32 of the upper housing 12. The opposing flaps 98 and 96 overlap and are joined together by fasteners such as screws (not shown). The lower flaps 98 and 96 cover only a rearward region of the lower housing. The forward region is open, to permit a saw blade to extend vertically below the structure while being partly received therein.

When assembled to the upper housing 12, the lower and upper cylindrical members 74 and 26 slide one within the other, such that the lower tube 74 telescopes from the upper tube 26. The respective tubes fit together with a snug fit to prevent air leakage.

Conveniently, the lower and upper housings 12 and 14 comprise sheet steel panels, and likewise the lower and upper tubes 26 and 74 comprise shaped sheet steel, which can be welded to the respective lower and upper housings 12 and 14. Alternative materials and modes of attachment of these components may be employed, according to methods and techniques known to those skilled in the art.

The enclosure 26 of the upper housing 12 conveniently joins with a flexible or jointed duct 90 for communication with the vacuum source 160 to draw air through the collector. The vacuum source 160 generates sufficient airflow and negative pressure within the collector 10 so as to draw in substantially all of the dust and other particles generated by the slab saw 170 during normal operation of the saw. Preferably, the vacuum source also includes a filter for removing dust and other particles. For example, a four inch flexible or jointed metal duct 90 may be provided that fits onto the connector 42, with suitable substantially airtight sealing or connection means being provided, not shown.

The vacuum source may comprise any conventional vacuum source capable of drawing a relatively high volume of air through the housing so as to minimize the escape of dust-laden air generated by the blade through the filter. The airflow provided by the vacuum source may be varied, depending on the particular application. Persons skilled in the art will readily be able to determine the appropriate airflow level for the selected application of the device.

Figure 11:
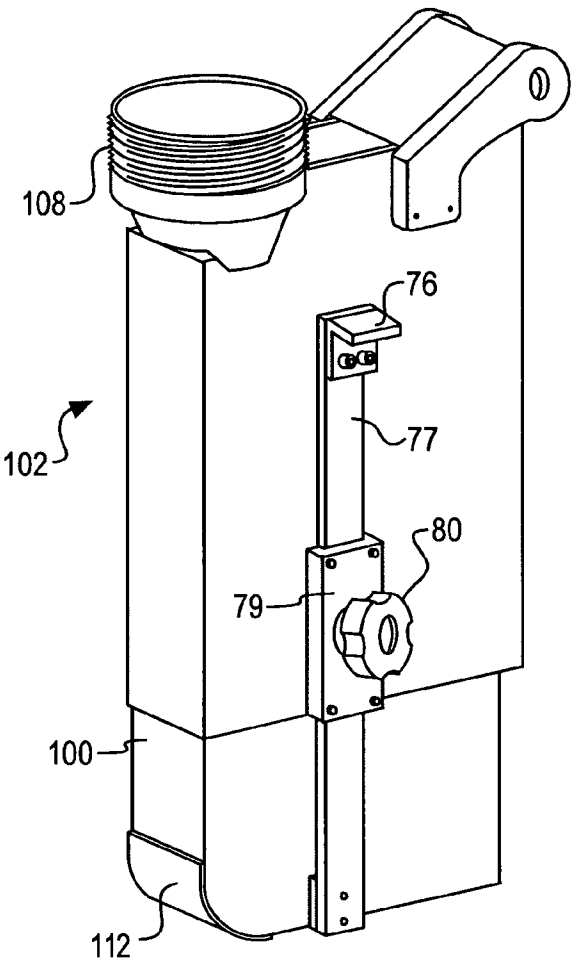
FIG. 11 is a perspective view of the embodiment of FIG. 10.
Figure 10:
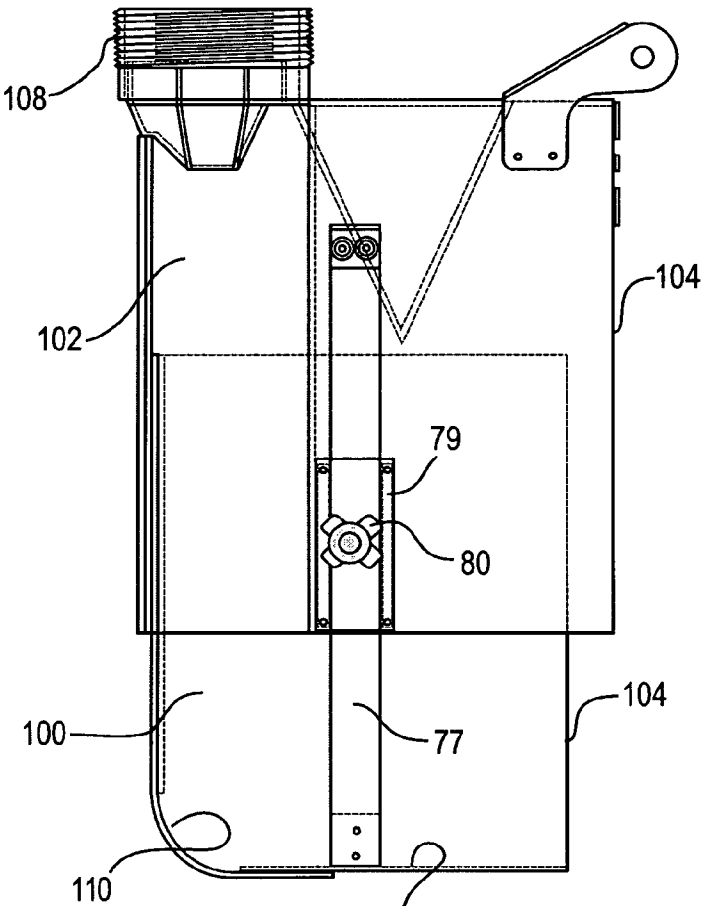
FIG. 10 is a side elevational view of a further embodiment, showing internal structure.

A second embodiment is illustrated in FIGS. 10 and 11. In this version, the lower and upper housings 100, 102 each are generally rectangular in overall configuration. The rear panels of the housings comprise generally flat plates. The interiors of the upper and lower housings communicate to form an uninterrupted hollow interior region that receives the circular saw blade. As with the first embodiment, the front faces 104 of both housings are open, and the lower housing 100 has a partially open lower face 106. The upper housing 102 includes a threaded coupling 108 at its upper rear corner, communicating with the interior of the compartments, to permit the threaded attachment of a duct (not shown). It will be seen that the threaded coupling 108 is but one convenient way to fasten a duct to the collectors; one skilled in the relevant art will understand that other types of couplers may be readily provided.

The rear lower corner 110 of the lower housing 100 is rounded and has a skid plate 112 mounted on the exterior surface of the rounded corner, to provide a ground contact surface that permits the collector 10 to slide along the ground.

The system includes a generally conventional slab saw 170, which includes a wheeled housing having a power unit. The slab saw includes a circular blade 18. It will be readily seen that essentially any type of circular blade 18 may be used in association with the invention. Although the collector may be used with a range of blade diameters, sizes and types, in one example, an 18" diamond blade is provided, for cutting into pavement.

A use of the collector 10 is illustrated in FIG. 1. According to this aspect, the dust collector 10 may be used for dry-cutting of asphalt, concrete, or other pavement 120. In one aspect, the trench-like cut 122 extends fully through the upper material into the sub-grade material 124, for example packed soil or the like. An advantage of dry-cutting in this type of application, rather than using more conventional wet-cutting methods, is that the sub-grade material does not cave in after the saw passes through, thereby leaving behind a narrow trench 122, substantially the width of the saw blade, in which the sidewalls of the cut are relatively clean and dry after the cut is made. In contrast, wet-cutting deposits a layer of mud on the walls of the cut, which requires significant effort and water to remove. As well, material removed from the dry cut is readily disposable, as it is in the form a dry dust which is filtered by the vacuum unit. In contrast, conventional wet-cutting generates mud, which requires special disposal methods. As well, dry-cutting dispenses with the requirement of transporting water tanks or locate water hook-ups or the like.

Thus, the use of slab saw to provide a narrow trench 122 that extends through the upper pavement level and into the sub-grade material provides a convenient and relatively inexpensive way to achieve a clean and dry cut. The width of the resulting trench will be determined by the width of the saw blade, with this depending on the desired application. For example, a narrow trench of this type may extend sufficiently below the pavement level to permit installation of one or more cables, such as fibre optic cables, within the resulting trench. Since these cables are entirely below the pavement level, the trench may then be partly filled with soil, sand, or the like, following which the pavement is fully restored to the full thickness of the original pavement.

It will be seen that the telescoping feature of the dust collector 10 permits it to be used in a variety of applications. For example, it permits the dust collector to be used with a variety of saw diameters. As well, pivoting of the dust collector relative to the saw assembly permits adjustment of the depth of the saw cut by varying the depth of blade extending below the dust collector 10. Conveniently, the dust collector 10 is positioned to substantially contact the pavement surface when in use, so as to minimize any air gap between the pavement and dust collector. This minimizes any possible leakage of dust from around the dust collector.

The foregoing discussion and description is intended to illustrate the concepts of the invention by way of representative examples, with emphasis upon the preferred embodiment or embodiments. The above description is not exhaustive of all options or mannerisms for practicing the disclosed principles of the invention, the full scope of which includes this patent specification as a whole, including the claims thereof. The full scope of the invention also includes functional and mechanical equivalents of elements set forth herein, including elements described explicitly or by implication as being a means for carrying out of a defined task or end. The inventor hereby states that it is his intention to rely upon the doctrine of equivalents in protecting the full scope and spirit of the invention, and to not be limited to any means described with particularity herein, for carrying out of a specified function.

The invention claimed is:

1. A slab saw for making a cut within a surface comprising pavement or other hard material, said saw comprising:

a frame;

a support for supporting the frame on the surface to maintain a selected depth of cut;

a rotatably driven circular blade mounted within said frame and extending downwardly therefrom to cut into said surface by a variable depth; and a shroud assembly mounted to said frame for collecting debris discharged from said blade, said shroud assembly comprising a pair of opposed spaced apart sidewalls, an at least partially open front and bottom configured to receive a portion of the blade within said shroud assembly, upper and lower segments displaceable relative to each other to vary the top to bottom length of the shroud assembly, a mount to fasten the upper segment to said frame whereby varying the length of said shroud assembly permits the shroud assembly to maintain a constant spacing above or on the surface as the depth of cut is changed, and an opening for connection to a vacuum source for collection of debris generated by said blade.

2. The slab saw as defined in claim 1, said shroud assembly further comprising an angled ground contact surface.

3. The slab saw as defined in claim 1, further comprising a baffle within the interior of said shroud assembly, said baffle comprising a plate positioned and configured for directing a flow of air generated by rotation of said blade, towards said opening.

4. The saw as defined in claim 3, wherein said baffle comprises a substantially V-shaped member comprising first and second opposing plates spanning the interior of said shroud assembly between said sidewalls, a first of said plates facing the front of said shroud assembly, and a second of said plates facing the rear of said shroud assembly.

5. The slab saw of claim 1, wherein said blade comprises a forward portion facing the direction of travel of said saw during a cutting operation and an opposed rearward portion, and said shroud assembly is mounted forwardly of said blade and configured to cover solely the forward portion of the blade.

6. The slab saw of claim 1, wherein sidewalls each comprise upper and lower plates defining the upper and lower segments, said plates being slideably disposed in relation to each other for displacement of the upper and lower segments relative to each other.

7. The slab saw of claim 1, wherein said upper and lower segments are attached together by a mutually engaging shaft and tube arrangement configured and operative to fasten the upper and segments together while permitting displacement thereof.

8. The slab saw of claim 1, wherein said mount comprises a pivot to permit pivotal movement of the shroud assembly relative to the frame.

9. The slab saw of claim 1, further comprising a vacuum source in communication with said opening.

10. A method of gathering debris generated by operation of a slab saw, comprising:

providing a slab saw comprising a frame, a support for supporting the frame on a surface to maintain a selected depth of cut, a rotatably driven circular blade mounted within said frame and extending downwardly therefrom to cut into said surface by a variable depth, and a shroud assembly mounted to said frame, said shroud assembly configured to receive a portion of the blade within said shroud assembly and comprising upper and lower segments displaceable relative to each other to vary the top to bottom length of the shroud assembly, a mount to fasten the upper segment to said frame, and an opening for connection to a vacuum source for collection of debris generated by said blade;

adjusting the position of the blade to make a cut of a selected depth into said surface; and varying the length of said shroud assembly by adjusting the relative positions of the upper and lower segments to maintain a constant spacing of the shroud above or on the surface.

11. The method of claim 10, wherein said blade comprises a forward portion facing the direction of travel of said saw during a cutting operation and an opposed rearward portion, and said shroud assembly is mounted forward of said blade and configured to cover solely the forward portion of the blade.

12. The method of claim 10, wherein sidewalls each comprise upper and lower plates defining the upper and lower segments, said plates being slideably disposed in relation to each other, and the step of varying the length of the assembly comprises displacing the upper and lower segments relative to each other.

13. The method of claim 10, wherein said upper and lower segments are attached together by a mutually engaging shaft and tube arrangement configured to fasten the upper and segments together, and varying the length of the assembly comprises adjusting the relative positions of said shaft within the tube.

* * * * *